US010519002B2

(12) United States Patent
Cook et al.

(10) Patent No.: US 10,519,002 B2
(45) Date of Patent: Dec. 31, 2019

(54) STAIRLIFT SPEED CONTROL

(71) Applicant: Stannah Stairlifts Limited, Hampshire (GB)

(72) Inventors: Paul Alexander Cook, Shrewton (GB); Gavin Scott Pugh, Farnham (GB)

(73) Assignee: Stannah Stairlifts Limited, Hampshire (GB)

( * ) Notice: Subject to any disclaimer, the term of this patent is extended or adjusted under 35 U.S.C. 154(b) by 265 days.

(21) Appl. No.: 15/552,717

(22) PCT Filed: Feb. 22, 2016

(86) PCT No.: PCT/GB2016/050446
§ 371 (c)(1),
(2) Date: Aug. 22, 2017

(87) PCT Pub. No.: WO2016/135467
PCT Pub. Date: Sep. 1, 2016

(65) Prior Publication Data

US 2018/0044133 A1 Feb. 15, 2018

(30) Foreign Application Priority Data

Feb. 23, 2015 (GB) ..... 1502998.6

(51) Int. Cl.
*B66B 1/30* (2006.01)
*B66B 9/08* (2006.01)

(52) U.S. Cl.
CPC ..... *B66B 1/30* (2013.01); *B66B 9/08* (2013.01); *B66B 9/0815* (2013.01)

(58) Field of Classification Search
CPC ..... B66B 1/30; B66B 9/08; B66B 9/815
See application file for complete search history.

(56) References Cited

U.S. PATENT DOCUMENTS 5,720,364 A * 2/1998 Glover ..... B66B 9/0838 187/201
7,051,841 B1 * 5/2006 Kasbergen ..... B66B 9/0838 187/201
8,607,936 B2 * 12/2013 Szentistvany ..... B66B 9/0838 104/230
2005/0279580 A1 * 12/2005 Szentistvany ..... B66B 9/0815 187/201
2008/0035430 A1 * 2/2008 Van Der Heiden ..... B66B 9/08 187/201

(Continued)

FOREIGN PATENT DOCUMENTS

EP 0738232 A1 10/1996
EP 2216284 A1 8/2010

(Continued)

*Primary Examiner* — Michael A Riegelman
(74) *Attorney, Agent, or Firm* — Dinsmore & Shohl LLP

(57) ABSTRACT

The invention provides a method and apparatus for controlling the speed of a stairlift (10). The speed of rotation of the carriage (12), whilst traversing bends in the rail (11), is monitored and the speed of the carriage drive motor (13) then controlled in reaction to the speed of rotation. A 3-axis gyroscope (31) is preferably used to monitor the speeds of rotation of the carriage (12) and the outputs from this gyroscope (31) may be processed to provide different degrees of speed control.

9 Claims, 3 Drawing Sheets

(56) References Cited

U.S. PATENT DOCUMENTS

| | | | | |
|---|---|---|---|---|
| 2008/0128213 | A1* | 6/2008 | Harris | B66B 9/08 187/201 |
| 2010/0274409 | A1* | 10/2010 | Smith | B66B 9/0838 700/304 |
| 2014/0060976 | A1* | 3/2014 | Szentistvany | B66B 9/0838 187/202 |
| 2014/0151157 | A1* | 6/2014 | Hall | B66B 9/0838 187/201 |
| 2014/0299416 | A1* | 10/2014 | Jakes | B66B 9/0838 187/201 |
| 2017/0158464 | A1* | 6/2017 | De Kroon | B66B 9/0838 |
| 2018/0044133 | A1* | 2/2018 | Cook | B66B 9/08 |
| 2018/0072537 | A1* | 3/2018 | Pugh | B66B 9/08 |

FOREIGN PATENT DOCUMENTS

| | | | |
|---|---|---|---|
| GB | 2391539 | A | 2/2004 |
| GB | 2457767 | A | 9/2009 |

* cited by examiner

STAIRLIFT SPEED CONTROL

CROSS-REFERENCE TO RELATED APPLICATIONS

This application is the U.S. National Phase of PCT/GB2016/050446 filed Feb. 22, 2016, which claims priority of United Kingdom Patent Application 1502998.6 filed Feb. 23, 2015.

FIELD OF THE INVENTION

This invention relates to stairlifts and, in particular, to a method of and/or system for controlling the speed of a stairlift.

BACKGROUND

Stairlifts typically comprise a rail following the contour of a staircase; a carriage mounted to move along the rail; and a chair mounted on the carriage, upon which the stairlift user sits during movement of the carriage along the rail. The rail of a curved stairlift will typically include bends in a vertical plane (called transition bends) and bends in a horizontal plane (called inside/outside bends). The rail may also include bends that combine vertical and horizontal elements (called helical bends).

The speed of a stairlift is limited, by regulation. Under EU regulations stairlift speed is limited to a maximum of 0.15 m/s but this limit may vary in other jurisdictions. The reference point at which speed is measured is a point on the surface of the stairlift chair, at a position forward of the rear edge.

In the case of curved stairlifts, when the carriage is moving through a negative transition bend (a bend in which the angle of inclination reduces in the uphill direction) the speed of the reference point on the chair will accelerate relative to the carriage. Similarly, as will be described in greater detail below, when the carriage is moving through certain types of horizontal bend (also referred to as an inside/outside bend), the reference point on the chair will typically proscribe a greater arc than the arc through which the carriage is moving and, accordingly, the reference point will accelerate relative to the carriage.

To ensure that the speed at the reference point does not exceed the prescribed upper limit, the stairlift carriage is typically slowed as it moves through bends. The changes of speed may be effected by placing switches along the rail, each switch serving to trigger a speed change in the carriage as the carriage moves past the switch. An alternative is to 'map' the rail in the broad manner described in our European Patent 0 738 232. In this case, the positions on the rail at which the carriage should be slowed or accelerated, are stored in an electronic memory. The position of the carriage on the rail is then monitored and the carriage speed then adjusted to that which is appropriate for the position on the rail.

Both speed control systems described above add material costs to a stairlift installation. Further, in an environment in which there is pressure to reduce installation time, both systems require the installer to undertake a set-up routine, particularly so in the case of the 'mapped' system.

It is an object of the present invention to provide a method of and/or apparatus for controlling the speed of a stairlift which goes at least some way addressing the problems identified above; or which at least offers a novel and useful choice.

SUMMARY OF THE INVENTION

Accordingly, in one aspect, the invention provides a method of controlling the speed of a stairlift, the stairlift having:

- a rail having at least one bend therein;
- a carriage mounted on said rail;
- a carriage motor operable to move said carriage along said rail; and
- a chair mounted on said carriage,
- said method including generating a signal representative of the speed of rotation of
- said carriage as said carriage moves through said at least one bend; and
- using said signal as a control to said carriage motor.

Preferably said carriage is rotatable with respect to said chair, said method including generating a signal representative of the relative angular velocity between said carriage and said chair as said carriage moves through a transition bend in said rail.

Preferably said method includes generating a signal representative of the angular velocity of said carriage as said carriage moves through a horizontal bend in said rail.

Preferably measurement of the rotational velocities of said carriage and said chair are effected using one or more gyroscopes mounted in or on said carriage and/or said chair.

Preferably signals from said one or more gyroscopes are processed to establish the speed of a point on said chair.

Preferably said method further comprises adjusting the speed of said carriage pre-emptively having regard to the position of said carriage on said rail.

In a second aspect, the invention provides a stairlift, including:

- a rail having at least one bend therein;
- a carriage mounted on said rail;
- a carriage motor operable to move said carriage along said rail; and
- a chair mounted on said carriage;
- said stairlift further including a speed control facility configured to generate a signal representative of the speed of rotation of said carriage as said carriage moves through said at least one bend; and to apply said signal as a control to the speed of said carriage motor.

Preferably said speed control facility includes one or more gyroscopes mounted on or in said carriage and/or said chair.

Preferably said speed control facility includes a 3-axis gyroscope mounted in said carriage.

In a third aspect the invention provides a stairlift when controlled according to the method set forth above.

Many variations in the way the invention may be performed will present themselves to those skilled in the art upon reading the following description. The description which follows should not be regarded as limiting but rather, as an illustration only of one manner of performing the invention. Where possible any element or component should be taken as including any or all equivalents thereof whether or not specifically mentioned.

BRIEF DESCRIPTION OF THE DRAWINGS

One form of the invention will now be described with reference to the accompanying drawings in which.

DESCRIPTION OF WORKING EMBODIMENTS

Figure 1:
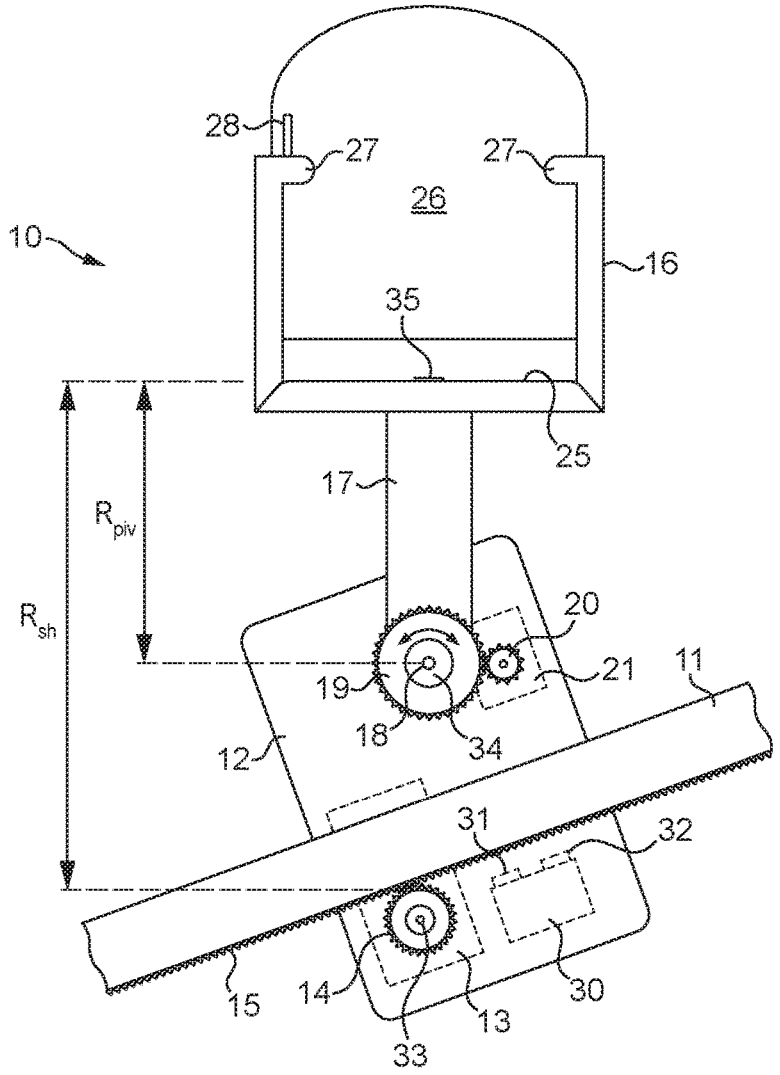
FIG. 1: shows a diagrammatic elevational view of a stairlift installation to which the invention may be applied.
Figure 2:
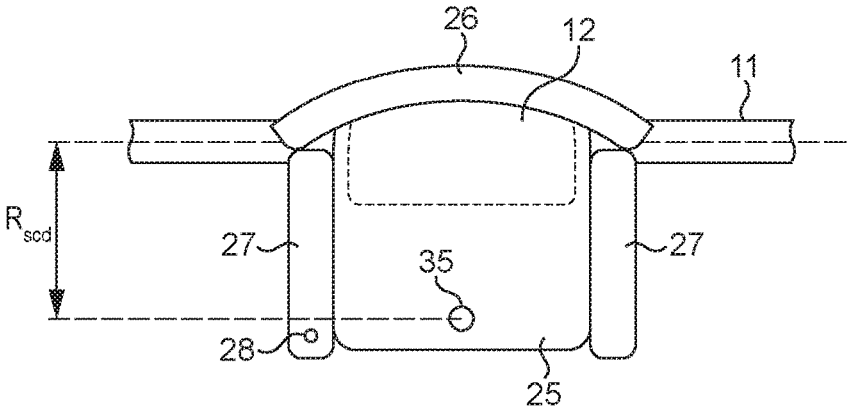
FIG. 2: shows a plan view of a stairlift carriage and chair mounted on a section of rail.

Referring firstly to FIGS. 1 and 2, the invention provides a method for controlling the speed of a stairlift 10; and a stairlift including a speed control facility. As is typical, the stairlift 10 includes a rail 11 that extends between adjacent levels in a building (not shown), and a carriage 12 mounted on the rail for movement along the rail. The carriage 12 includes a carriage drive motor 13 to displace the carriage up and down the rail 11, a pinion 14 mounted on the output of the motor meshing with a drive rack 15 extending along the underside of the rail 11. Those skilled in the art will appreciate that other drive arrangements could be used, the precise drive arrangement not forming part of this invention.

Mounted on, and extending above, the carriage 12 is a chair 16. As is well known in the art, the chair is mounted in such a manner that, when the carriage 12 moves through a transition bend in the rail, the chair remains horizontal. In some stairlifts, the chair and carriage are rotated as a unit with respect to the rail but, in the embodiment described herein, the chair is fixed to the upper end of arm 17, the lower end of arm 17 being pivotally mounted to the carriage along axis 18. A leveling gear 19 is fixed to the arm about axis 18, the gear 19 meshing with pinion 20 mounted on the output of a leveling motor 21. Thus, as the carriage 12 moves through transition bends in the rail 11 (later described with reference to FIG. 3 below), the orientation of the carriage relative to the chair is altered by operation of the motor 21 to maintain the chair substantially level.

In the form shown the chair 16 comprises a seat surface 25, a backrest 26, and spaced armrests 27. A user-operated control 28 is mounted on one of the armrests to allow a user seated in the chair to control the movement of the carriage along the rail. Although not shown for reasons of clarity, the chair will also typically include a footrest to support the user's feet during operation of the stairlift.

Control of the carriage drive motor 13 and the leveling motor 21 is effected by an electronic control unit (ECU) 30 mounted within the carriage. The ECU 30 receives inputs from the hand control 28 as well as from various sensors mounted on the carriage 12 and/or the chair 16 to ensure appropriate operation of the leveling motor 21 to maintain the seat 25 level at all times. These sensors preferably include a gyroscope 31 mounted in the carriage and arranged to provide an output representative of the speed of rotation of the carriage in transition bends (roll). The gyroscope 31 may also have the functionality to measure the speed of rotation as the carriage moves through horizontal bends (yaw), this being so if the gyroscope is a 3-axis gyroscope. However the speed of rotation in yaw could also be measured using a gyroscope mounted on the chair. The sensors further include a carriage accelerometer 32, a carriage encoder 33 operable to monitor the rotation of the drive pinion 14, and a chair encoder 34 operable to monitor the rotation of the chair leveling gear 19.

Those skilled in the art will recognize that means of measuring rates of angular rotation other than gyroscopes could be used in reducing the invention to practice without departing from the scope of the invention.

The maximum allowable speed of a stairlift is regulated. European Standard EN 81-40:2008 (E) establishes the position of a speed reference point indicated by 35 in the drawings. This point is located on the longitudinal centerline of the seat 25, 250 mm forward of a vertical line down through the forward face of the backrest 26. The standard prescribes that the speed of the reference point 35 shall not exceed 0.15 m/s in any direction. In other jurisdictions the speed limit may be some other figure.

Figure 3:
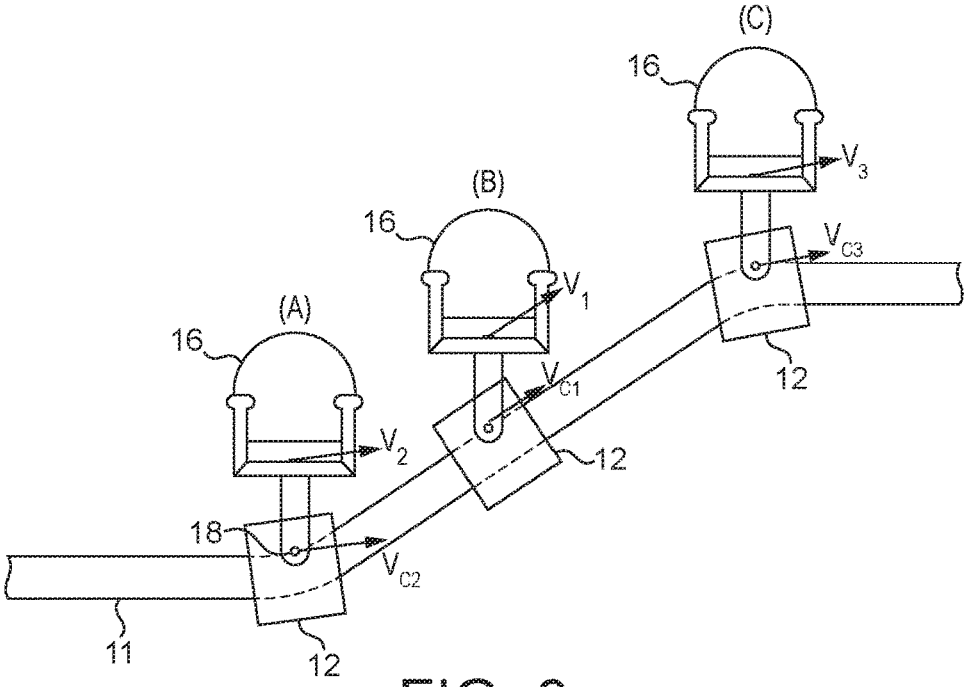
FIG. 3: shows a diagrammatical elevational view of part of a stairlift rail, and a carriage at different positions on that rail.
Figure 4:
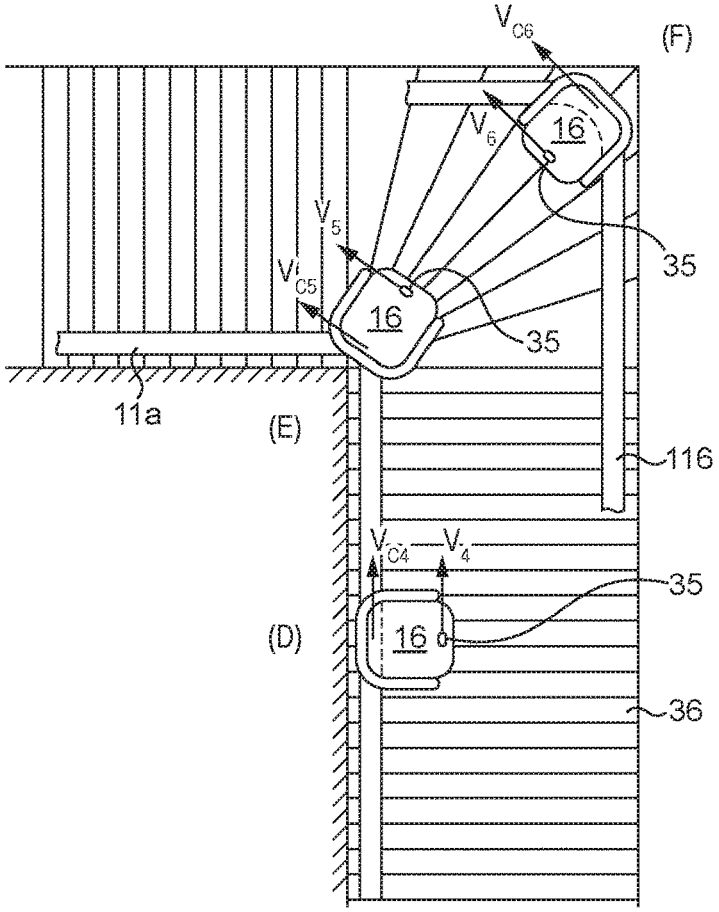
FIG. 4: shows a diagrammatical plan view of part of alternative rail mounting configurations, and a carriage at different positions on the rails shown.

Turning now to FIGS. 3 & 4, it will be appreciated that, as the stairlift carriage moves along the rail, the speed of the speed reference point 35 may vary relative to the speed of the carriage. In FIG. 3 a section of rail 11 is shown in elevation, the section including a positive transition bend at (A) and a negative transition bend at (C). It follows that, for the purposes of this disclosure, a positive transition bend is a bend in a vertical plane in which the angle of inclination of the rail increases when moving in an upward direction. A negative transition bend is a bend in a vertical plane in which the angle of inclination of the rail reduces when moving in an upward direction. Assuming a constant carriage speed, when the stairlift is moving along a straight section of rail, e.g. position (B) in FIG. 3, the reference point 35 will be moving at the same speed as the carriage i.e. $V_1=V_{C1}$. When the carriage is moving through a positive transition bend the reference point 35 moves through a shorter arc than the carriage and thus $V_2<V_{C2}$. When the carriage moves through a negative transition bend, the reference point 35 moves through a longer arc than the carriage and is thus speeded-up relative to the carriage. $V_3>V_{C3}$. It is thus apparent that the critical determining point or points for speed control are when the carriage is moving through a negative transition bend.

FIG. 4 illustrates alternative sections of rail 11 in a substantially horizontal plane. Rail section 11*a* is mounted on the inside of a staircase 36 and includes an inside bend at position (E) while rail section 11*b* is mounted on the outside of the staircase and includes an outside bend at position (F). It will be appreciated that, in reality, a stairlift installation will normally include either all inside or all outside bends and, providing there are no physical limitations to dictate otherwise, it is preferred to mount the rail on the inside edge of the staircase 36.

When the carriage is moving along a straight section of rail, as shown at position (D) in FIG. 4, $V_4=V_{C4}$. When the carriage is moving through the inside bend (E) as shown, the reference point 35 moves through a longer arc than the carriage and is thus speeded up relative to the carriage. $V_5>V_{C5}$.

When the carriage is moving through the outside bend (F) as shown, the reference point 35 moves through a shorter arc than the carriage and $V_6<V_{C6}$.

Returning to FIGS. 1 & 2, physically the chair seat is offset from the carriage by an effective radius Rpiv above the rail/carriage pivot point. The seat itself is a certain distance Rsh above the rail/drive pinion interface. The reference point 35 on the chair surface is also cantilevered outwards from a vertical plane through the centerline of the rail by a distance Rscd.

When the chair is leveling upon the carriage traversing a transition curve in the rail (in reality, the chair maintaining level as the carriage displaces), the chair surface is assumed to be moving in a partial circle of radius Rsh while the leveling arm supporting the chair surface is also rotating about a radius of Rpiv.

A basic form of speed control according to the invention may be effected as follows: Output signals from the 3-axis gyroscope are monitored by the ECU 30. Should the signals in either roll or yaw (generated by the carriage moving through a transition bend or horizontal bend respectively) exceed pre-determined thresholds, the ECU triggers the carriage drive motor 13 to slow down to a prescribed lower speed. The thresholds applied to the gyroscope outputs, and the carriage drive motor speeds, are set to ensure that the speed of the reference point 35 on the chair does not exceed the prescribed limit in both transition bends or horizontal bends.

The speed control method described above contemplates the carriage moving at two defined speeds only, a higher speed when traversing straight sections of rail and a lower speed when traversing bends. However the use of gyroscopes or similar electronic devices provides an opportunity to incorporate a more sophisticated reactive speed control system wherein the speed of the reference point 35 is continually calculated and the speed of the carriage drive motor 13 controlled to maintain a higher overall speed.

To this end the speed of the reference point in rail bends is first established.

Simplified equations to describe the relative motion aligned to the stairlift rail for transition or roll curves are:

$$\text{Roll Component Speed}=((2\pi R_{piv})\times(\acute{\text{Ø}}_{gyro\ roll}\ \text{Sec}^{-1}/360)\times(\cos \acute{\text{Ø}}_{gravity}))+((2\pi(R_{sh}-R_{piv}))\times(\acute{\text{Ø}}_{gyro\ roll}\ \text{Sec}^{-1}/360))$$

Where $\acute{\text{Ø}}_{gyro\ roll}\ \text{Sec}^{-1}$ is the carriage gyro output. $\acute{\text{Ø}}_{gravity}$ is the carriage accelerometer angle versus gravity.

There is an extra term to describe the additional speed caused by inside/outside or yaw curves:

$$\text{Yaw Component Speed}=(2\pi Rscd)\times(\acute{\text{Ø}}_{gyro\ yaw}\ \text{Sec}^{-1}/360)$$

So the complete equation is:

$$\text{Chair True Speed}=\text{Carriage Speed along rail}+((2\pi R_{piv})\times(\acute{\text{Ø}}_{gyro\ roll}\ \text{Sec}^{-1}/360)\times(\cos \acute{\text{Ø}}_{gravity}))+((2\pi(R_{sh}-R_{piv}))\times(\acute{\text{Ø}}_{gyro\ roll}\ \text{Sec}^{-1}/360))+(2\pi Rscd)\times(\acute{\text{Ø}}_{gyro\ yaw}\ \text{Sec}^{-1}/360)$$

This set of equations is simple enough for an on-board microcontroller to calculate in real time, based on the accelerometer and gyroscopic data from the chair and carriage. This means that at any point the chair seat speed can be calculated and the speed of the carriage motor 13 controlled, reactively, to maintain the speed of the reference point 35 at the desired level. Ignoring other limitations, this speed level may be the maximum permitted by the regulations.

It will be appreciated that the system for calculating true chair speed is entirely reactive and, accordingly, the carriage takes time to change speed when entering and exiting bends. To improve system efficiency it is advantageous to include some form of pre-emptive speed adjustment around those positions on the rail where significant changes of speed occur. A further advantage of pre-emptively adjusting the speed is that excessive changes of speed, which could and invariably would arise in a purely reactive system attempting to maximize speed, can be removed.

These adjustments are made depending on the position of the carriage on the rail and may vary according to the nature and angle of the bend being negotiated. The pre-emptive adjustment facility is preferably 'self-learning', relying on data held in memory of speed settings (or change in speed settings) at particular positions along the rail which will ensure comfortable changes in speed while maintaining optimum overall speed.

Figure 5:
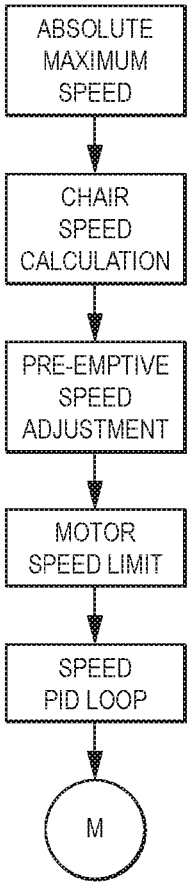
FIG. 5: shows a basic speed control diagram that includes elements of the invention.

Turning now to FIG. 5, the diagram shows the sequence of the inventive method. The maximum possible speed at which the carriage can travel is reduced by a calculation of the true speed at reference point 35 on the chair in the manner described above, the true chair speed being limited to not more than 0.15 m/s. Following adjustment of the carriage speed to accommodate the need not to exceed the prescribed true chair speed, the carriage speed may be further adjusted, in an essentially pre-emptive manner as described above, to compensate for the reactive nature of the speed control system described and to smooth out major changes in speed as the carriage moves through bends.

Finally, after the allowable chair speed is calculated and if necessary adjusted, an appropriate signal is applied to a conventional PID loop to rotate the motor 13 at the speed demanded. In this case feedback control is provided by encoder 33.

It will thus be appreciated that the present invention provides a novel method and system for controlling chairlift speed that, even in its most basic form, overcomes the identified shortcomings of the prior art and, in more sophisticated embodiments allows closer control of carriage speed to enable higher overall speed of journeys.

The invention claimed is:

1. A method of controlling the speed of a stairlift, the stairlift having:

a rail having at least one bend therein;

a carriage mounted on said rail;

a carriage drive motor operable to drive said carriage along said rail; and a chair mounted on said carriage, said method including generating a signal representative of a speed of rotation of said carriage as said carriage moves through said at least one bend; and using said signal as a control to said carriage drive motor.

2. The method as claimed in claim 1 wherein said carriage is rotatable with respect to said chair, said method including generating a signal representative of the relative angular velocity between said carriage and said chair as said carriage moves through a transition bend in said rail.

3. The method as claimed in claim 1 including generating a signal representative of the angular velocity of said carriage as said carriage drives through a horizontal bend in said rail.

4. The method as claimed in claim 1 wherein measurement of the rotational velocities of said carriage are effected using one more gyroscopes mounted in or on said carriage and/or said chair.

5. The method as claimed in claim 4 wherein signals from said one or more gyroscopes are processed to establish the speed of a point on said chair.

6. The method as claimed in claim 1 further comprising storing speed data to a memory and adjusting the speed of said carriage based on the stored data having regard to the position of said carriage on said rail.

7. A stairlift, including:

a rail having at least one bend therein;

a carriage mounted on said rail; a carriage drive motor operable to drive said carriage along said rail; and a chair mounted on said carriage;

said stairlift further including a speed control facility configured to generate a signal representative of a speed of rotation of said carriage as said carriage moves through said at least one bend; and to apply said signal as a control to a speed of said carriage drive motor.

8. The stairlift as claimed in claim 7 wherein said speed control facility includes one or more gyroscopes mounted on or in said carriage and/or said chair.

9. The stairlift as claimed in claim 7 wherein said speed control facility includes a 3-axis gyroscope mounted in said carriage.

* * * * *